United States Patent [19]

Terasaka

[11] 3,982,458

[45] Sept. 28, 1976

[54] DIE SET

[76] Inventor: Tetsuichi Terasaka, No. 54, 1-chome Choeiji, Higashi-Osaka, Osaka, Japan

[22] Filed: Nov. 24, 1975

[21] Appl. No.: 634,839

[30] Foreign Application Priority Data

June 24, 1975 Japan ..... 50-89639[U]

[52] U.S. Cl. ..... 83/685; 83/698; 83/699

[51] Int. Cl.[2] ..... B26F 1/06

[58] Field of Search ..... 83/685, 698, 699, 563; 72/446, 448

[56] References Cited

UNITED STATES PATENTS 3,327,575 6/1967 Duffee et al. ..... 83/698 X

*Primary Examiner*—J. M. Meister

*Attorney, Agent, or Firm*—George B. Oujevolk

[57] ABSTRACT

A die set includes a first die holder having a first die detachably fixed thereto, and a second die holder having a second die detachably fixed thereto. The first die holder is slidable towards and away from the second die holder. The second die is supported by means of plural supports movable up and down on the second die holder, and is removable out of the supports. A drive means mounted in the second die holder enables simultaneous up and down movement of the supports.

4 Claims, 8 Drawing Figures

DIE SET

The present invention relates to a die set.

In a conventional die set, when a lower die is mounted on a lower die holder, the die is inserted laterally from the side of the die holder. After placing the die on the die holder, the die is secured by a suitable clamp means. However during insertion of the die, since the die holder and the die are scratched together, the lower face of the die as well as the upper face of the die holder is injured and worn. As a result when the die is held on the die holder by a clamp means, there occurs some rattle of the die, i.e., the die is not securely mounted on the die holder.

An object of the invention is to eliminate the above defect, and to provide a die set enabling a die to be mounted by a ready process without injuring the die or the die holder.

A further object of the invention is to provide a die set incorporating a clamp means making it possible to firmly secure a die to a die holder.

Other objects and features of the invention will be apparent from the following description of the invention with reference to the accompanying drawings, in which.

Throughout the drawings, similar parts and elements are shown by the similar reference numerals.

Figure 1:
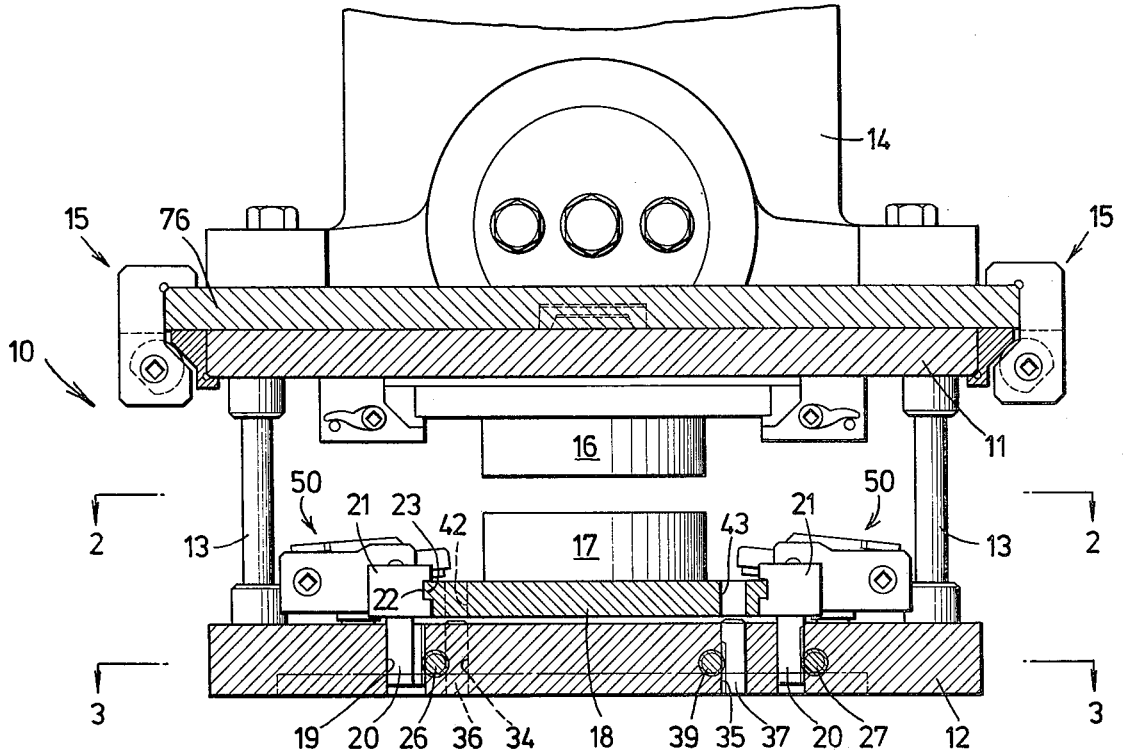
FIG. 1 is a front elevation, sectioned in part, of a die set attached to a ram of a press machine.
Figure 2:
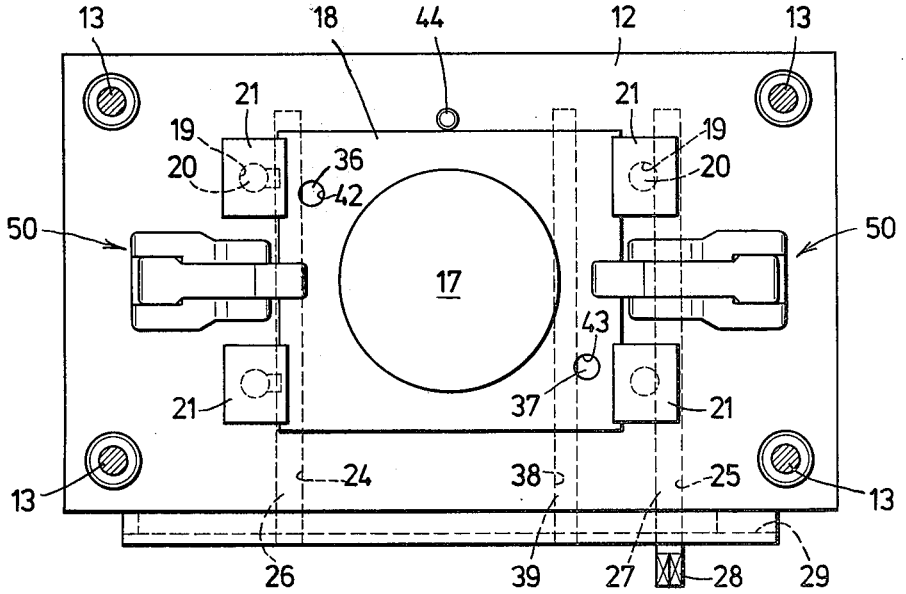
FIG. 2 is a horizontal section taken substantially along the line 2—2 of FIG. 1.
Figure 3:
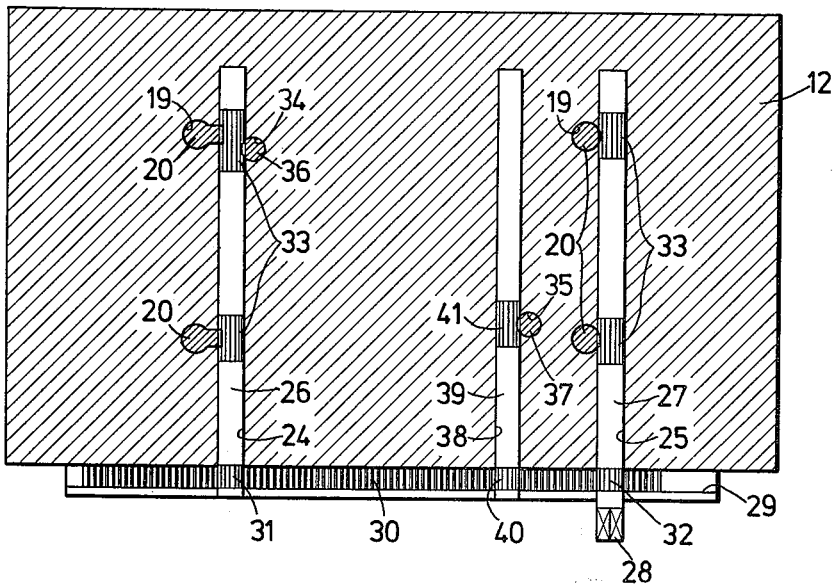
FIG. 3 is a horizontal section taken substantially along the line 3—3 of FIG. 1.

Referring now to FIGS. 1 through 3, a die set generally indicated at 10 comprises an upper die holder 11, and a lower die holder 12 mounted below said upper die holder 11 by means of guide posts 13 slidably inserted in the lower die holder 12, the upper die holder 11 being movable towards and away from the lower die holder 12 by the action of a ram 14 of a press machine. The upper die holder 11 is connected to the ram 14 by means of connectors generally indicated at 15, the details of which will be explained hereinafter. To the upper holder 11 is secured an upper die 16, and on the lower holder 12 is securely mounted a lower die 17 having an integral setting plate 18.

In the lower holder 12 are provided opposed pairs of vertical holes 19 adjacent the four corners of the setting plate 18. In each of the vertical holes 19 is slidably inserted a shaft 20 having at its upper end a support 21 provided with a horizontal guide groove 22 at the inner side face thereof. The supports 21 are so arranged that the guide grooves 22 can slidably receive opposed shoulders 23, 23 provided at the side edges of the setting plate 18.

In the lower holder 12 are provided lateral blind holes 24 and 25 in parallel to each other so as to communicate with the vertical holes 19. In the lateral holes 24 and 25 are rotatably inserted rods 26 and 27 respectively. The latter rod 27 projects out of the front face of the lower holder 12 and has a square end 28 engageable with a suitable handle for rotating it. At the front face of the lower holder 12 is provided a transverse channel 29 at right angles to the lateral holes 24 and 25 in communication therewith. In the channel 29 is slidably fitted a rack 30 engaging peripheral teeth 31 and 32 provided about the rods 26 and 27 respectively, whereby the rotation of the rod 27 causes the rod 26 to rotate in the same direction. Also about the rods 26 and 27 are formed teeth 33 engaging a rack tooth provided axially on each of the vertical shafts 20 so that the rotations of the rods 26 and 27 cause the simultaneous up and down movements of the supports 21.

In the lower holder 12 are provided a pair of vertical holes 34 and 35, in which are slidably inserted positioning pins 36 and 37 respectively, each of said pins having an axial rack tooth. Parallel to the lateral hole 25 and in communication with the vertical hole 35 is provided a blind hole 38 in which is rotatably inserted a rod 39 having teeth 40 and 41 meshing the rack 30 and the rack tooth of the pin 37, respectively. The rack tooth of the other pin 36 engages one of the teeth 33 of the rod 26. By the arrangement, when the rod 27 is rotated clockwise, the shafts 20 are elevated and the pins 36, 37 are lowered. When the rod 27 is reversed, the shafts 20 are lowered and the pins 36, 37 are elevated. For receiving the pins 36 and 37, there are provided a pair of positioning holes 42 and 43 in the setting plate 18 of the lower die 17, respectively. If desired, a stop 44 may be provided for the limitation of the slide of the setting plate 18 upon insertion thereof in the guide groove 22 of the supports 21.

Figure 4:
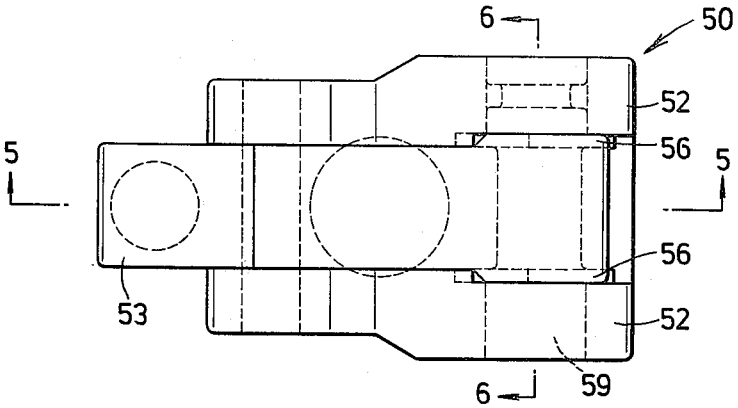
FIG. 4 is a plan view showing a clamp means for setting a die on a die holder.
Figure 5:
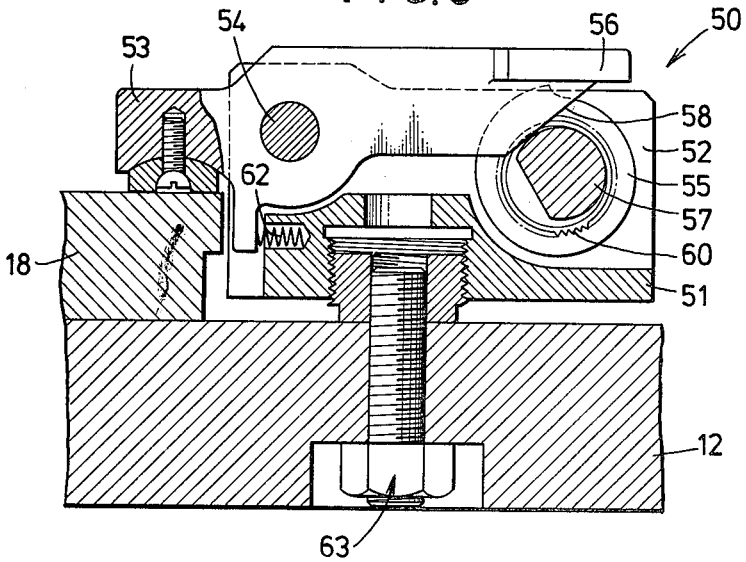
FIG. 5 is a sectional view of the above, taken substantially along the line 5—5 of FIG. 4.
Figure 6:
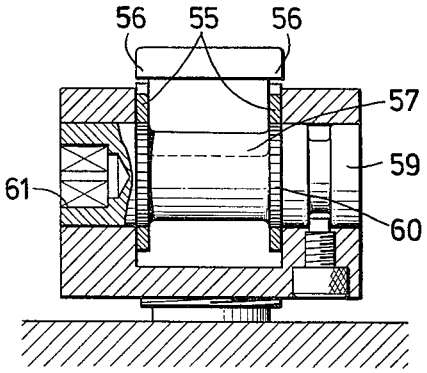
FIG. 6 is a sectional view of the above, taken substantially along the line 6—6 of FIG. 4.

Between the front and rear supports 21 are provided an opposed pair of clamp means generally indicated at 50. The clamp means are for holding the lower die 17 on the lower holder 12 so as not to rattle. As shown in FIGS. 4 through 6, the clamp means 50 comprises a support element 51 having forked portions 52, 52 between which is pivotally supported a clamping nail 53 by means of a pin 54, a pair of first cams 55 engageable with shoulders 56 projecting at both sides of one end portion of the nail 53, and a second cam 57 engageable with a slant or cam surface 58 provided at one end of the nail 53. The first cams 55 engage a rotary shaft 59 by means of serrations 60 which enable the adjustment of positions of the first cams. The second cam 57 is eccentrically fixed to the rotary shaft 59 between the first cams 55 and 55. The shaft 59 has a square hole 61 in one end for the engagement with a suitable handle. The nail 53 is urged by a spring 62 away from the setting plate 18 of the lower die 17 to be clamped by the clamp means 50 which is mounted on the lower die holder 12 by a bolt and nut means 63 which enables the adjustment of the height of the means 50 relative to the setting plate 18. In operation, by the rotation of the shaft 59, initially the cams 55 cause the nail 53 to abut against the setting plate 18, and then the second cam 57 effects the nail 53 to press the setting plate 18 against the upper face of the die holder 12. Since the arrangement has a double cam means, the effective cam face of each cam can have smaller inclination, thereby enabling increase of the operative force of the cam effecting on the nail 53. Furthermore, the clamp of the setting plate 18 can be performed by a single and ready operation, i.e., solely by the rotation of the shaft 59. Such clamp means can also be mounted on the upper die holder 11 for holding the upper die 16.

Figure 8:
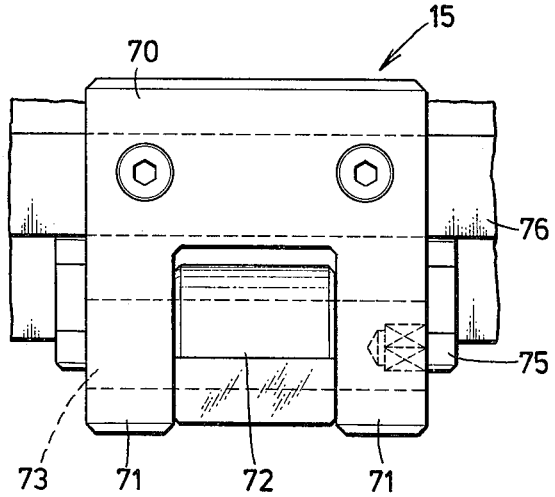
FIG. 8 is an enlarged front view of the above.
Figure 7:
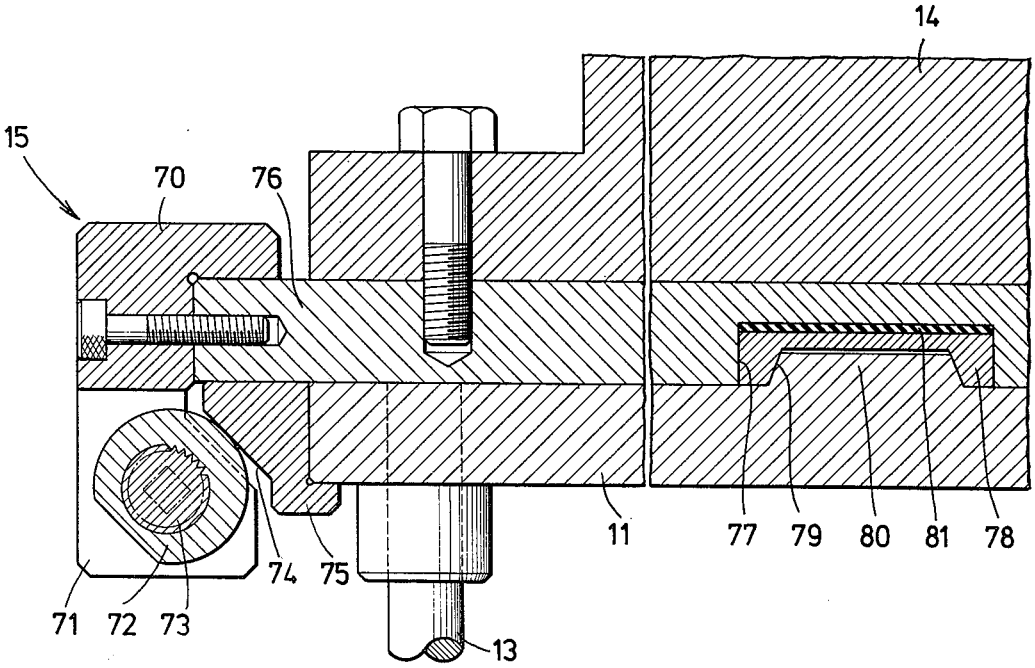
FIG. 7 is an enlarged vertical section of a connector for securing a die set to a ram of a press machine.

As mentioned before, the upper die holder 11 is secured to the ram 14 by means of connectors 15. As shown in FIGS. 7 and 8, each of the connectors 15 comprises a support member 70 having opposed arms 71 and 71 between which is rotatably supported a cam 72 by means of a rotary shaft 73 having a square hole at one end for the insertion of a suitable handle. A part of the outer periphery of the cam 72 is adapted to project inwardly of the arms 71 to engage a slant 74 of an element 75 fixed to the upper die holder 11. Since the support member 70 is fixed to a plate 76 secured to the ram 14, the rotation of the shaft 73 causes the cam 72 to press the slant 75, thereby securely connecting the upper holder 11 to the ram 14 of the press machine. The arrangement assures the tight connection between the ram 14 and the upper holder 11 by a ready operation. For the precise positioning of the upper die holder 11 when connected to the ram 14, a cavity 77 is provided at the center of the plate 76. In the cavity 77 is fitted a disc 78 having at its center a frusto-conical depression 79 complementary to a tapered projection 80 provided on the die holder 11 at the center thereof. The disc 78 is movable up and down within a range defined by a cushioning 81 connecting the disc 78 to the bottom of the cavity 77.

Upon tightening the die holder 11 by means of the connectors 15, the projection 80 is fitted in the depression 79 of the disc 78. According as the rotation of the cam 72, the projection 80 is raised into the depression 79 of the disc 78 which is in turn pressed against the bottom of the cavity 77. During the process the position of the upper holder 11 is adjusted by the slidable engagement between the outer periphery of the projection 80 and the inner periphery of the depression 79, thereby enabling the exact positioning of the die holder 11 in relation to the ram 14.

When setting the lower die 17 on the lower holder 12, initially the rod 27 is rotated clockwise by means of a handle. As a result the rods 26, 27 and 39 are rotated in the same direction to cause the vertical shafts 20 together with the supports 21 to elevate while the pins 36 and 37 to sink into the die holder 12. Thereafter the setting plate 18 of the lower die 17 is inserted between the opposed supports 21, 21 so that the shoulders 23 of the plate 18 engage the guide grooves 22. The insertion is limited by the stop 44. Then the rod 27 is rotated counterclockwise to lower the supports 21 holding the setting plate 18 and to elevate the positioning pins 36 and 37. During lowering the setting plate 18, if the pins 36 and 37 are not in alignment with the positioning holes 42 and 43, the setting plate 18 is adjusted along the guide grooves 22 of the supports 21. After the setting plate 18 contacts to the upper face of the holder 12, the shaft 59 of the clamp means 50 is rotated so that the nail 53 thereof firmly holds the setting plate 18 on the holder 12 without rattle.

As described above, since the supports 21 are raised above the upper face of the die holder 12 at a space enough to permit the insertion of the setting plate 18 of the die 17, it will not scratch the upper face of the die holder 12 during the insertion of the die, thereby eliminating the injure and wear of both members 12 and 18.

Furthermore since the positioning pins 36, 37 and the supports 21 are simultaneously moved up and down by the rotation of the rod 27, the die 17 can be quickly and readily set at the precise position on the die holder 12.

What is claimed is:

1. A die set comprising a first die holder movable towards and away from a second die holder spaced below said first die holder detachably fixed to a ram of a press machine by connector means, a first die detachably secured to said first die holder, a second die having a setting plate supported at both sides by means of opposed pairs of supports mounted on the second die holder so as to be movable up and down, plural positioning pins slidably inserted in said second die holder and fittable into holes provided in said setting plate, drive means for elevating and lowering the supports and the positioning pins in the simultaneous manner that the formers move reversely to the latters, and a clamp means for firmly holding the setting plate on the second die holder.

2. A die set as claimed in claim 1, wherein said connector means comprises a support element fixed to the ram, and a cam means rotatably supported by said support element, said cam means being engageable with a slant provided at each side of the first die holder.

3. A die set as claimed in claim 1, wherein said drive means comprises a pair of parallel first rods rotatably mounted in said second die holder in geared relation with a slidable rack mounted transversely to said first rods, a vertically slidable shaft fixed to each of said supports in geared relation with said first rods, and a second rod rotatably mounted in said second die holder in parallel to said first rods and in geared relation with said slidable rack as well as one of said positioning pins, the other positioning pin being geared with one of said first rods, the gearings between the positioning pins and the first and second rods being so adapted that the simultaneous rotations of the first and second rods cause the pins to move in the reverse direction to said vertical shafts.

4. A die set as claimed in claim 1, wherein said clamp means comprises a support member pivotally supporting a clamping nail provided at one end with first and second surfaces respectively engageable with first and second cams rotatably mounted on said support member, the first cam being adapted to effect initial rotation of the clamping nail, and the second cam being adapted to cause effective pressure of the clamping nail against said setting plate.

* * * * *